United States Patent [19]

Robertson et al.

[11] Patent Number: 4,770,101

[45] Date of Patent: Sep. 13, 1988

[54] MULTIPLE FLECHETTE WARHEAD

[75] Inventors: William J. Robertson, Sillery; Maurice A. Laviolette, Orleans, both of Canada

[73] Assignee: The Minister of National Defence of Her Majesty's Canadian Government, Ontario, Canada

[21] Appl. No.: 51,838

[22] Filed: May 19, 1987

[30] Foreign Application Priority Data

Jun. 5, 1986 [CA] Canada ..... 510920

[51] Int. Cl.[4] ..... F42B 13/50

[52] U.S. Cl. ..... 102/489; 102/357; 102/517; 102/703; 102/393

[58] Field of Search ..... 102/340, 342, 351, 357, 102/489, 703, 517, 393

[56] References Cited

U.S. PATENT DOCUMENTS

| | | | |
|---|---|---|---|
| 3,334,588 | 8/1967 | Larsen | 102/703 |
| 3,771,455 | 11/1973 | Haas | 102/703 |
| 3,956,990 | 5/1976 | Rowe | 102/703 |
| 4,638,737 | 1/1987 | McIngvale | 102/703 |

FOREIGN PATENT DOCUMENTS

| | | | |
|---|---|---|---|
| 144293 | 6/1985 | European Pat. Off. | 102/489 |
| 3343515 | 6/1985 | Fed. Rep. of Germany | 102/489 |

OTHER PUBLICATIONS

*Sub-Munition Rockets from Brandt Armaments,* International Defense Review, 5/1984, p. 645.

*Primary Examiner*—Harold J. Tudor
*Attorney, Agent, or Firm*—Leonard Bloom

[57] ABSTRACT

A sub-munition warhead contains several flechettes arranged in a circumferential pattern. A canister with a length less than that of the flechettes surrounds the rear ends of the flechettes. A frangible fairing extends from the canister to a small diameter nose cone. An indexer adjacent the nose cone and a sabot for each flechette retain the flechettes in position on a piston joining the canister and the nose cone. The warhead is normally launched with a rocket motor. It is spun so that on burnout, the warhead is travelling at high speed and spinning. On burnout, a fuze is ignited and the piston is propelled down the canister. This drives the flechettes forwardly, rupturing the fairing and allowing the flechettes to separate for independent flight to a target.

11 Claims, 2 Drawing Sheets

MULTIPLE FLECHETTE WARHEAD

BACKGROUND OF THE INVENTION

The present invention relates to sub-munition warheads and more particularly to such a warhead containing a number of heavy kinetic energy penetrators known as "flechettes".

The warhead of the present invention has been developed for use with unguided air to surface rockets as an area weapon against armoured vehicles. The use of such weapons involves the firing of several rockets, each fitted with a multiple flechette warhead, at a tank formation. On rocket burnout, the individual flechettes separate from each warhead and these aerodynamically stabilized flechettes continue to the target, where they retain enough kinetic energy to penetrate the armour.

With a warhead of this sort, the flechettes must be contained and rigidly retained in an aerodynamic shell to ensure high velocity when the flechettes are released. The flechettes must be expelled on rocket burnout and the expulsion, which occurs at very high velocity (e.g. 1200 m/s), must take place with minimum disturbance to the flechettes to ensure a clean flight and optimum terminal effects. In addition, the means for retaining and expelling the flechettes should be of minimum weight to maximize the velocity of the rocket and minimize the possibility of damaging the launching aircraft with ejected debris. The warhead of the present invention has been developed with these desiderata in mind.

SUMMARY OF THE INVENTION

According to the present invention there is provided a sub-munition warhead comprising a plurality of flechettes arranged in a circumferential pattern and a canister containing rearward portions of the flechettes and having a length less than that of a flechette. A nose cone is positioned forwardly of the flechettes and has a diameter substantially less than the diameter of the canister. A frangible fairing extends between the nose cone and the canister. Flechette expulsion means are provided for driving the flechettes forwardly from the canister so as to break the frangible fairing which fairing is then aerodynamically stripped away when in use, with the flechettes thereafter separating for independent flight to a target.

This configuration of a warhead allows for a minimum length with low drag. The low drag results in a higher burnout velocity for the rocket and warhead system. Additionally, a relatively short canister and the frangible fairing allow the flechettes to be ejected from the warhead after a relatively short travel with respect to the canister. The small diameter nose cone not only contributes to low drag but also allows the flechettes to separate and move past the nose cone after ejection without interference.

In preferred embodiments of the invention, the flechettes are held in place by index means at the nose and tail of each flechette and by a sabot engaged between the flechette and the canister. On ejection, the sabots separate from the flechettes and the flechettes separate from the index means with a minimum of retarding interference.

BRIEF DESCRIPTION OF THE DRAWINGS

In the accompanying drawings, which illustrate an exemplary embodiment of the invention.

DETAILED DESCRIPTION OF PREFERRED EMBODIMENT

Figure 1:
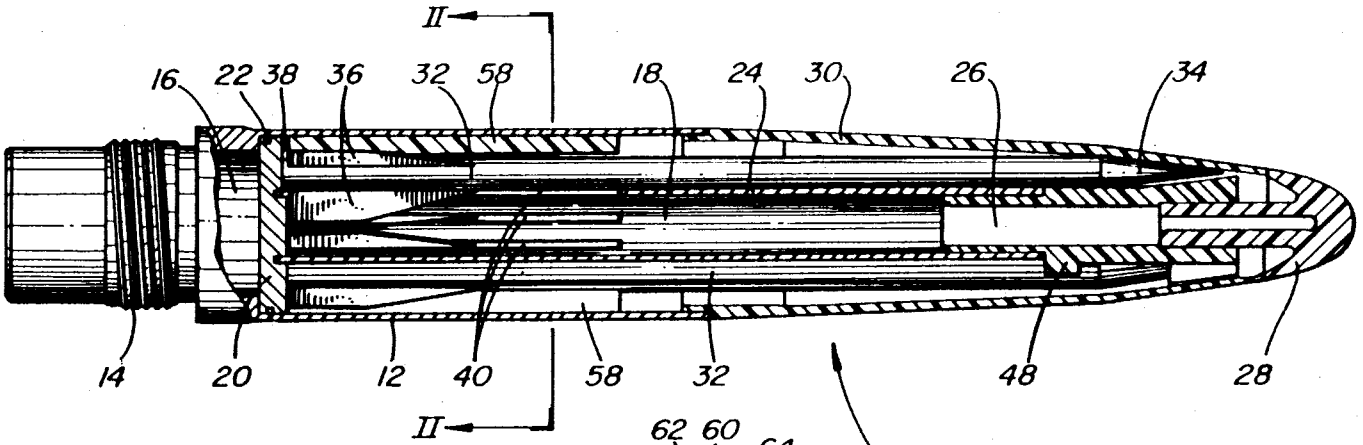
FIG. 1 is a side view, partially in longitudinal section of a warhead according to the present invention.

Referring to the drawings, there is illustrated a warhead 10 with a rear section configured as a canister 12 with a threaded coupling 14 for mounting on the front of a rocket motor. The canister and coupling portion of the warhead contains an ejection charge 16 for purposes that will be described in the following.

A piston 18 is fitted in the canister 12. It includes a circular piston base 20 with a circumferential O-ring seal 22 that engages the interior wall of the canister 12. An axially located piston tube 24 extends forwardly from the piston base to complete the piston. The forward end of the piston tube 24 is secured to an indexer 26 that will be described in more detail in the following. Secured to and forwardly of the indexer 26 is a nose cone 28.

A frangible fairing 30 extends between the trailing edge of the nose cone 28 and the leading edge of the canister 12 to complete the outer envelope of the warhead. Fairing 30 is preferably provided with several (e.g. three) equally circumferentially spaced longitudinally extending lines of weakening to enhance rupture of the fairing and aerodynamic stripping as described hereafter. The fairing 30 presents a smooth aerodynamic surface and tapers downwardly toward the nose cone to reduce air friction. The trailing edge of fairing 30 is recessed to receive the forward edge of the canister so that a smooth joint 31 is provided between them, such joint 31 being pinned or adhesively secured to attach the fairing 30 to the canister 12. The forward end of fairing 30 is in abutting relation to the trailing edge of the nose cone so that a smooth joint is provided between them. The joint may be lightly bonded to ensure proper registration. The frangible fairing 30 is made of any one of several well-known synthetic plastics compositions capable of breaking up into fragments under the forces applied thereto in use, as will be described hereafter.

Figure 2:
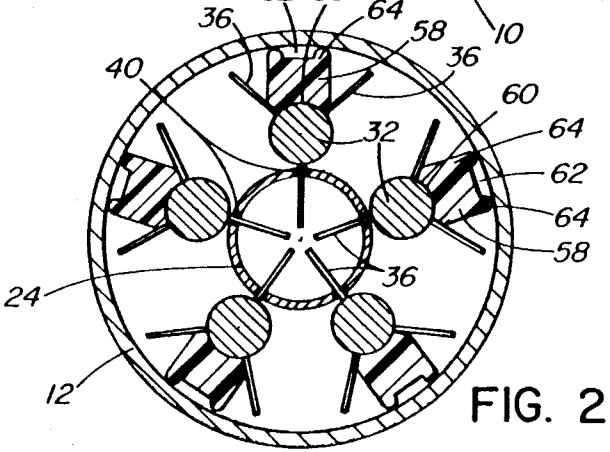
FIG. 2 is a cross-section view along II—II of FIG. 1.
Figure 3:
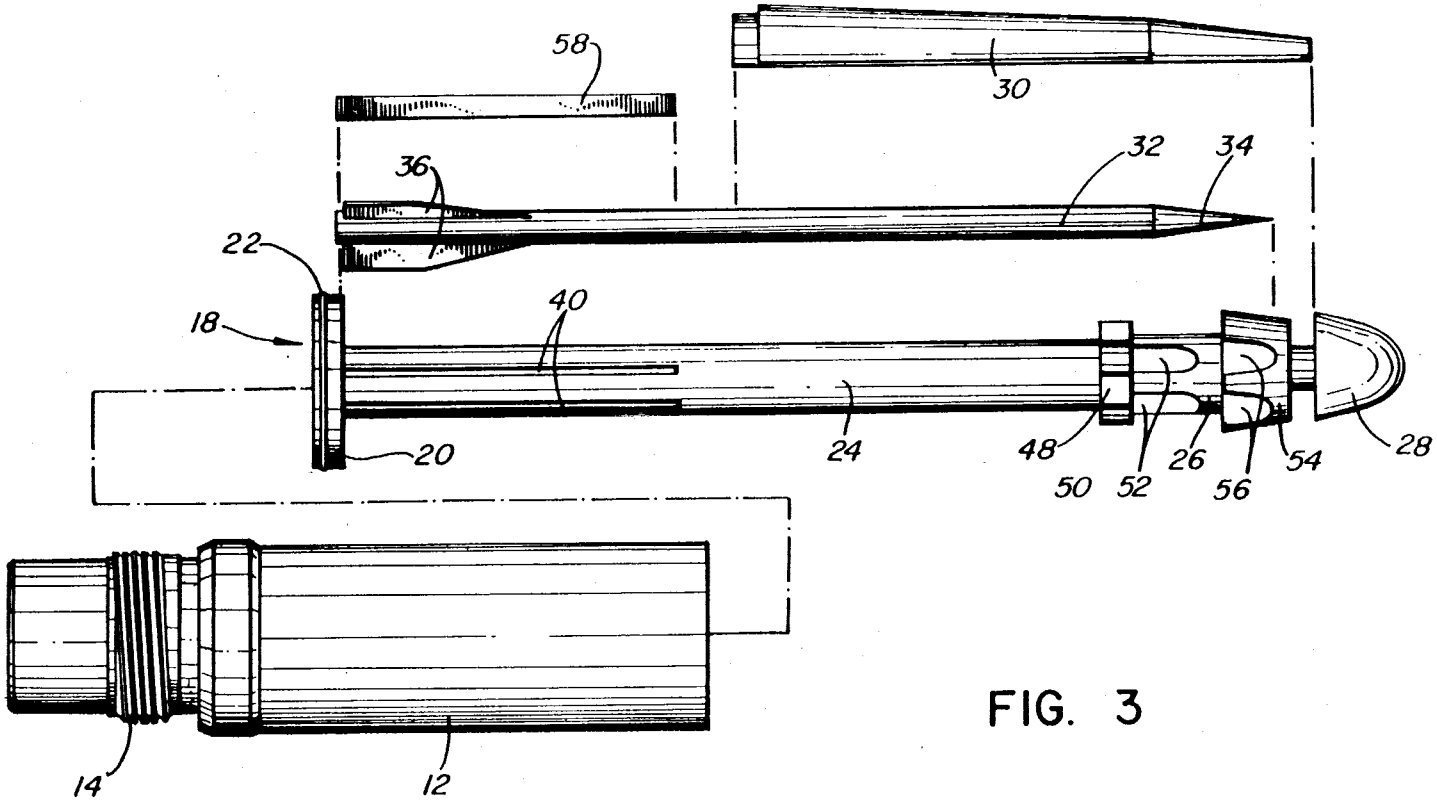
FIG. 3 is an exploded view showing the parts of the warhead, with only one flechette, one sabot and one fairing section being shown for the sake of clarity.

Carried inside the warhead are five flechettes 32, each having a slender, rod like body with a tapered, conical nose 34 at the leading end and three symmetrically arranged fins 36 at the trailing end. The flechettes are arranged symmetrically around the piston tube 24 with the base of each flechette seated in a radial groove 38 in the front face of the piston base 20. Five axial slots 40 in the piston tube 24 accommodate fins on respective flechettes, as illustrated most clearly in FIG. 2.

At the forward end of the piston tube 24, the indexer 26 has an annular flange 48 with longitudinal grooves 50 that accommodate the flechettes immediately behind the tapered nose sections 34. Immediately forward of the flange 48, the main body of the indexer 26 is grooved at 52 and an enlarged, forwardly tapered head 54 is also grooved at 56 to receive and retain the forward end of each flechette.

To retain the flechettes radially against the piston tube 24, five small sabots 58 are fitted between the respective flechettes and the canister 12. The inner face 60 of each sabot is configured to engage and retain the flechette, while the outer face of the sabot is grooved at 62 to provide two longitudinal ribs 64 that engage the inner face of the canister 12.

In operation, the rocket motor carrying the warhead is fired with the warhead intact. The motor is normally spun up by thrust and aerodynamic forces so that on burnout, the warhead will be travelling at high speed and spinning. On burnout of the rocket motor, the ejection charge 16 is ignited in known fashion and propells the piston 18 along the canister 12 to drive the piston, indexer 26 and nose cone 28, along with the flechettes 32, axially forwardly from the canister. The forwardly moving flechettes 32 engage the fairing 30 thus rupturing the frangible fairing, especially along the lines of weakening provided therein. The frangible fairing 30 is then aerodynamically stripped away. The sabots 58 then separate from the flechettes and the flechettes separate from the piston 18 and nose cone assembly due to spin and differential drag. The flechettes move past the relatively small diameter nose cone 28 after ejection without interference and continue on to the target.

The relatively small diameter of the nose cone, as compared with the canister diameter and to the diameter of the circumferential array of flechettes, the relatively short canister 12 and the use of a downwardly tapered frangible fairing contribute to a short length warhead with low drag and minimal disturbance of the flechettes on release. The low drag of the system results in a high burnout velocity, which is of great importance for kinetic energy warheads.

To minimize the weight of the system, a number of the components may be made of lightweight materials, for example, plastics materials. Such components can include the fairing, the sabots, the indexer and the nose cone.

A preferred embodiment of the invention has been described by way of example. Those skilled in this art will appreciate that numerous modifications and variations may be made while remaining within the scope or spirit of the invention as set out in the appended claims.

We claim:

1. A warhead comprising a plurality of flechettes arranged in a circumferential pattern, a canister containing rearward portions of the flechettes and having a length less than that of the flechettes, a nose cone positioned forwardly of the flechettes, a frangible fairing extending between the nose cone and the canister, and flechette expulsion means including piston means slidable in the canister and an ejection charge for driving the piston along the canister and in turn driving the flechettes forwardly from the canister so as to break the frangible fairing and allow the flechettes to separate for independent flight to a target, and the nose cone being sufficiently small in diameter as to avoid interference thereof with the flechettes after the expulsion thereof by the flechette expulsion means.

2. A warhead according to claim 1, wherein the piston means has a piston base engaging the aft end of each flechette.

3. A warhead according to claim 2, including index means for retaining the flechettes in respective predetermined circumferential positions spaced around the piston means.

4. A warhead according to claim 3, wherein the index means include an indexer mounted on the piston means adjacent the nose cone, the indexer having grooves formed therein adapted to engage forward ends of the flechettes, the index means further including slots formed in the piston means which slots are adapted to receive fins on the flechettes.

5. A warhead according to claim 4, including sabots engaged between the canister and the flechettes.

6. A sub-munition warhead comprising a plurality of flechettes arranged in a circumferential pattern, a canister containing rearward portions of the flechettes and having a length substantially less than that of the flechettes, a nose cone positioned forwardly of the flechettes, a frangible fairing surrounding forward portions of the flechettes, which fairing extends between the nose cone and the canister and which fairing reduces in diameter toward the nose cone, a flechette expulsion means including an axially extended piston means secured to the nose cone and slidable in the canister and an ejection charge for driving the piston means along the canister thus in turn driving the flechettes forwardly from the canister so that they come into interference with and break the frangible fairing so as to cause aerodynamic stripping of the fairing when in use to allow the flechettes to separate for independent flight to a target, and wherein the maximum diameter of said nose cone is sufficiently small in relation to the canister diameter and to the diameter of the circumferential array of flechettes as to enable the flechettes to move past the nose cone without interference after expulsion by the flechette expulsion means and to continue on to the target.

7. A warhead according to claim 6, wherein the piston means has a piston base engaging the aft end of each flechette.

8. A warhead according to claim 7, including index means for retaining the flechettes in respective predetermined circumferential positions spaced around the piston.

9. A warhead according to claim 8, wherein the index means include an indexer mounted on the piston means adjacent the nose cone, the indexer having grooves formed therein to engage forward ends of the flechettes.

10. A warhead according to claim 9, wherein the index means further includes slots formed in the piston means adapted to receive fins on the flechettes.

11. A warhead according to claim 8, including sabots engaged between the canister and the flechettes.

* * * * *